United States Patent [19]

Candela

[11] Patent Number: 4,469,935

[45] Date of Patent: Sep. 4, 1984

[54] COMBINED DOMESTIC USE AND SPACE HEATING ELECTRIC WATER HEATER

[76] Inventor: François Candela, 10639 boul. St-Michel, Montreal, Quebec, Canada

[21] Appl. No.: 395,985

[22] Filed: Jul. 7, 1982

[30] Foreign Application Priority Data

Jun. 3, 1982 [CA] Canada ..... 404423

[51] Int. Cl.[3] ..... H05B 1/02; F24H 1/22; F24H 7/02

[52] U.S. Cl. ..... 219/314; 219/302; 219/321; 219/326; 219/330; 219/328; 219/341

[58] Field of Search ..... 219/310, 312, 314, 320, 219/321, 328, 331, 302, 341, 330, 325, 326

[56] References Cited

U.S. PATENT DOCUMENTS

| | | | |
|---|---|---|---|
| 2,036,815 | 4/1936 | Leader | 219/302 X |
| 2,151,854 | 3/1939 | Knapp | 219/314 |
| 2,515,974 | 7/1950 | Araldsen | 219/326 |
| 2,748,249 | 5/1956 | Collerati | 219/302 |
| 3,256,991 | 6/1966 | Kamrud | 219/314 X |
| 3,437,078 | 4/1969 | Olson | 219/314 X |

FOREIGN PATENT DOCUMENTS

| | | | |
|---|---|---|---|
| 570316 | 7/1945 | United Kingdom | 219/314 |

*Primary Examiner*—A. Bartis

*Attorney, Agent, or Firm*—Cushman, Darby & Cushman

[57] ABSTRACT

An electric water heater for heating a first volume of water for domestic use and a second volume of water for space heating includes a tank receiving water to be heated for domestic use by a first electric heating element mounted in a lower part of the tank. A heating unit is mounted within the mid-section of the tank above the first heating element and includes a first chamber having openings allowing circulation of domestic use water from the tank therethrough, a second closed chamber receiving water to be heated for space heating and a third closed chamber communicating with the second chamber and having an outlet for supplying heated water to a space heating system. A second electric heating element is provided in the first chamber and the second chamber is defined by a series of serially connected compartments, each having a heat conducting element comprising an inverted U-shaped hollow tube in heat collecting communication with the first chamber. A third electric heating element is provided in the third chamber. The tank has an outlet for supplying heated water for domestic use.

12 Claims, 4 Drawing Figures

FIG. 1
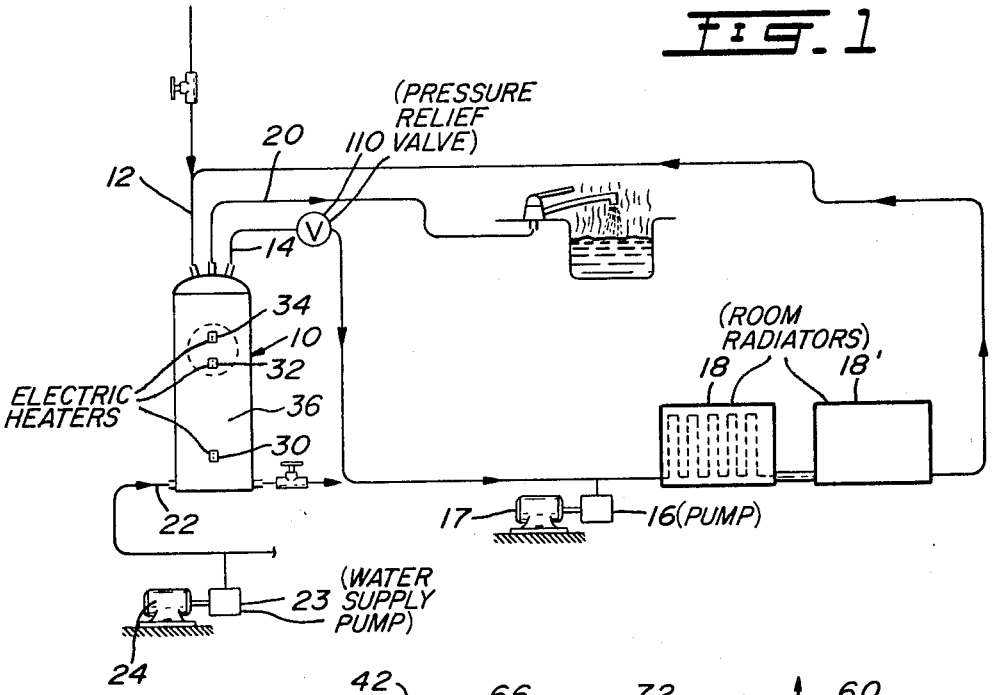
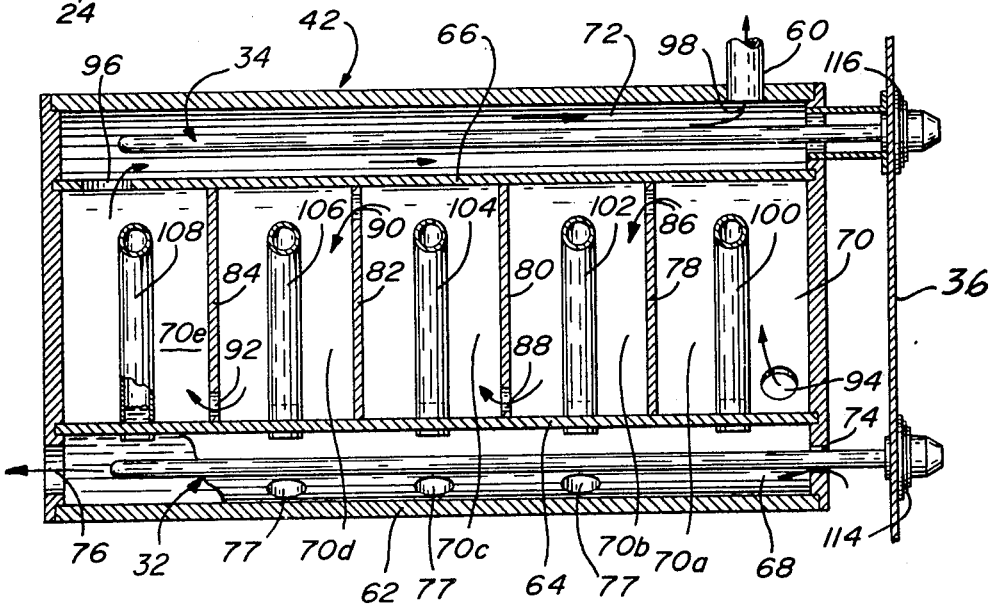
FIG. 3

12
20
110
14
38
56
10
36
58
98
60
66
34
72
42
94
40
54
70
77
50
62
48
46
64
76
32
68
44
52
(MAGNESIUM
51 ROD)
30
112
(THERMOSTAT)
22

124 (THERMOSTAT)
122 (TRANSFORMER)
T
128
126
132
130
134 BREAKER
119
118
S
VALVE
V
110
14
20
12
120
THERMO COUPLE
ELECTRIC HEATERS
10
116 (THERMOSTAT)
114 (THERMOSTAT)
112 (THERMOSTAT)
22
16 PUMP
17
ROOM RADIATORS
18
18'

COMBINED DOMESTIC USE AND SPACE HEATING ELECTRIC WATER HEATER

FIELD OF THE INVENTION

The present invention relates to a water heating system and, more particularly, to a hot water heater for heating water for domestic use and water for space heating or radiator use.

BACKGROUND OF THE INVENTION

Various electrical water heating units combining domestic water heating and space heating are known; one such system is described in U.S. Pat. No. 3,502,843 issued Mar. 24, 1970 to Stryer. This unit consists of two boilers, one nested within the other, which provide hot water for heating a space and domestic hot water for washing and other purposes. The interchange of heat is effected between the boilers which, although nested within the one another, do not allow hot water from one boiler to exchange heat to the water of the other boiler by circulating through it. There is, therefore, no constant transfer of heat from one system to the other to mimimize the use of heating elements.

OBJECTS AND STATEMENT OF THE INVENTION

It is an object of the present invention to provide a combined domestic use and space heating hot water system comprising an efficient arrangement of heating elements and chambers and using the heat of one hot water system for heating the water of the other system thereby greatly reducing the amount of electrical power normally required for heating each system separately.

It is also an object of the present invention to provide a hot water heater which is compact in design and efficient.

The present invention makes use of a tank and of a heating unit mounted within the tank. The heating unit includes a first chamber which allows passage of the water for domestic use and two other chambers for passage of the water to be heated for space heating or radiator use. One of the two last-mentioned chambers include heat exchange elements which are in communication with the first chamber so that heat collected from the water in the first chamber may be transferred to the water passing through to the second chamber. One electric heating element is mounted within the tank and two others are mounted within a heating unit also mounted inside the tank. One of the two last-mentioned electric heating elements is mounted within the first chamber while the other is mounted within the third chamber.

The present invention, therefore, relates to a hot water heater for heating a first volume of water for domestic use and a second volume of water for space heating. The heater includes:

a tank, and means for supplying water to the tank to be heated for domestic use, and means for supplying water to be heated for space heating purposes. A first electric heating element is located in the lower part of the tank for heating the water in the tank for domestic use. Other means are provided for supplying water in the tank to be heated for space heating. A heating unit mounted within the tank, includes first chamber means having openings for allowing the water for domestic use to pass therethrough and a second electric element positioned in that first chamber means. A second closed chamber means is also provided for receiving the water supplied in the tank for space heating purposes, a heat exchange means is located in the second chamber means which is in heat collecting communication with the first chamber means, and a third closed chamber means is in fluid communication with the second closed chamber means with a third electric heating element being provided in that third chamber means. The apparatus also includes means for collecting water from the third chamber means and for supplying that water for space heating uses.

The present invention is also concerned with a hot water system which comprises a hot water heater as defined above and means for circulating the water for domestic use and the water for space heating through the tank.

The scope of applicability of the present invention will become apparent from the detailed description given hereinafter; it should be understood, however, that this description, while indicating preferred embodiments of the invention, is given by way of illustration only since various changes and modifications within the spirit and scope of the invention will become apparent to those skilled in the art.

IN THE DRAWINGS

FIG. 1 is a schematic representation of a hot water heater system in accordance with the present invention;

FIG. 3 is a cross-sectional view of the water heating unit inside the tank and is shown on the sheet illustrating FIG. 1.

DESCRIPTION OF PREFERRED EMBODIMENTS

Figure 2:
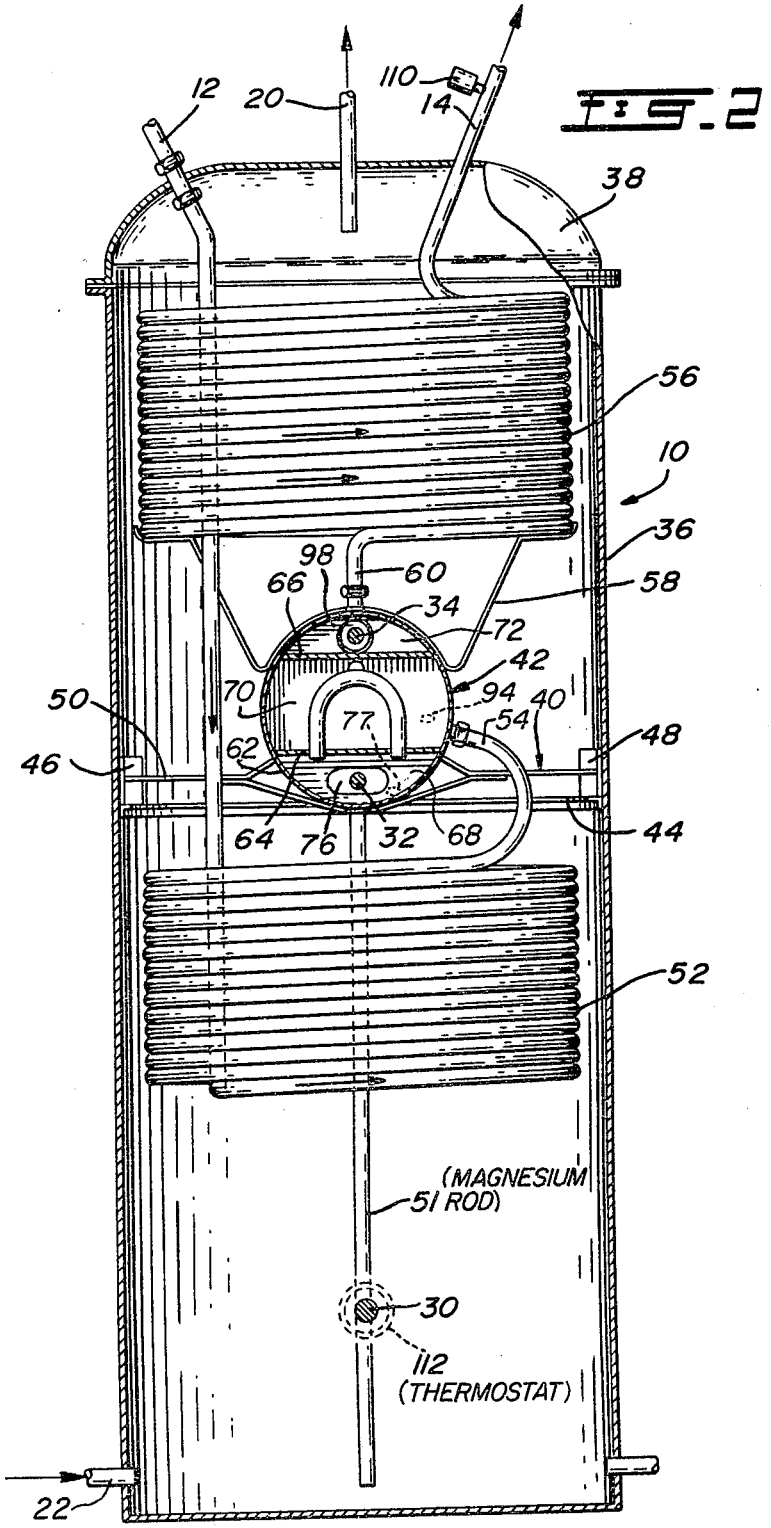
FIG. 2 is a cross-sectional view of the upper part of the tank shown in FIG. 1.

Referring to FIG. 1, the hot water heating system of the present invention comprises a hot water tank 10 with an inlet piping 12 and an outlet pipe 14 connected through a water circulation pump 16, driven by a motor 17, to a series of radiators (two of which are shown as 18, 18') to define a closed water circulating system for space heating. Another outlet line 20 is also provided to supply hot water for domestic uses. Also connected to the tank 10, is a cold water supply pipe 22 which is connected to a source of cold water (not shown); for certain water sources, such as a well, a water circulation pump 23 driven by a motor 24 is required. Three heating elements 30, 32 and 34 respectively referred to herein as first, second and third electric heating elements, are mounted to the cylindrical body 36 of the tank and their function will be described further below.

Referring to FIG. 2, a cover 38 covers the top portion of the cylindrical body 36 in a manner that it can be easily removed therefrom should working inside the tank be required. One conventional construction of cylindrical body 36 and cover 38 is steel lined throughout its interior with porcelain enamel; it is sufficiently resistant and water-tight so as to be fully filled with water to be heated. Fixedly mounted to the interior wall of the cylindrical body 36 is a support assembly 40 which secures, inside the tank, a unit 42 for further receiving and heating water inside the tank. The support assembly 40 includes a peripheral annular member 44 on which rest two anchor blocks 46 and 48 to which is secured a support plate 50 having its center portion adapted to hold unit 42. A rod of magnesium 51, conventionally found in hot water tanks, is used to protect the tank from corrosion.

Inlet piping 12 of the radiator system extends down the tank and forms a first coil arrangement 52 with its upper outlet 54 connected to the water heating unit 42. The outlet pipe 14 of the radiator system is also connected at 60 to unit 42 through a second coil arrangement 56 disposed in the upper portion of the tank. Coil arrangement 56 rests on the heating unit 42 by means of an appropriately shaped support structure 58.

Referring to FIG. 3, the water heating unit 42 consists of a cylindrical body 62 with two dividing walls 64 and 66 together defining a first chamber 68, a second chamber 70 and a third chamber 72. Chamber 68 has an inlet orifice 74 and an outlet orifice 76 to allow passage of a portion of the domestic water heated inside the tank to pass through this chamber for further heating by element 32. A series of openings 77 may also be provided on opposite sides of chamber 68 for allowing even distribution of heat to the water inside the chamber. The second chamber 70 consists of a series of compartments, five of which are shown in FIG. 3 as 70*a*, 70*b*, 70*c*, 70*d*, 70*e*. These compartments are defined by a series of dividing walls 78, 80, 82, 84 extending between walls 64 and 66 and each includes a passage 86, 88, 90, 92 allowing fluid communication between adjacent compartments. The first chamber 70*a* has an opening 94 to which is connected the inlet pipe 54 of FIG. 2. The last compartment 70*e* has an opening 96 allowing fluid communication with the third heating chamber 72. The third element 34 extends in chamber 72 which has an opening 98 connected to the outlet pipe 60.

In each compartment 70*a*, 70*b*, 70*c*, 70*d*, 70*e* is mounted an inverted-U shaped heat exchange element 100, 102, 104, 106, 108, each in the form of a bent hollow tube and having its opposite end portions opened to the chamber 68 and communicating with the water heated in chamber 68. Due to the pressure existing in the water tank, some of the heated water in chamber 68 fills a portion of the lower end portions of 100, 102, 104, 106, 108 to a height corresponding to that shown in dotted lines in FIG. 3. The hot water inside chamber 68 transfers heat to the metallic elements which are in contact with the water circulating through these compartments.

A pressure relief valve 110 is inserted in the outlet circuit 14 should the pressure inside the heating unit 42 exceed a given value.

Figure 4:
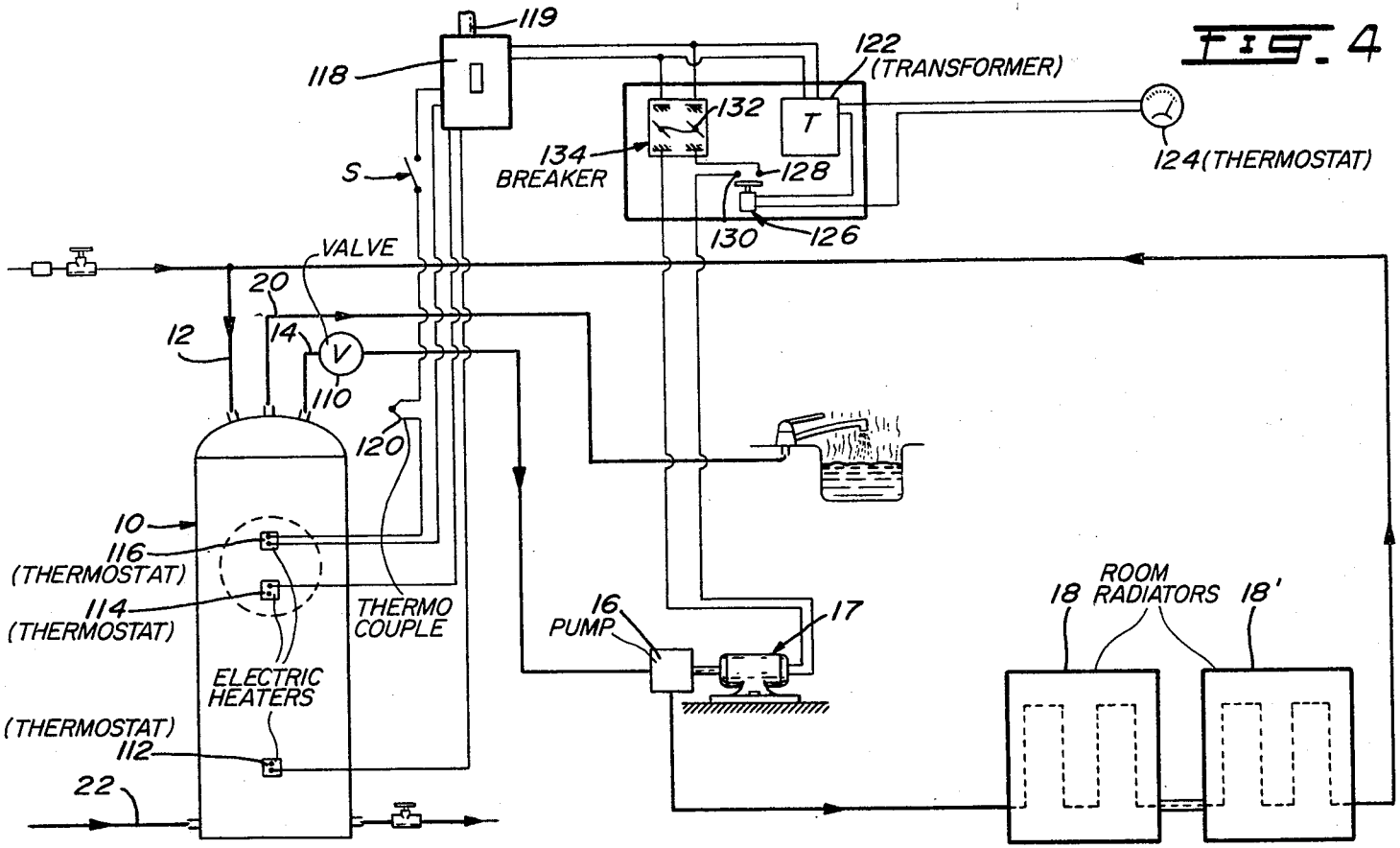
FIG. 4 is a schematic view of the electrical circuits used with the apparatus of the present invention.

Referring to FIG. 4, each element 30, 32, 34 has a thermostat 112, 114, 116 which is electrically connected to a circuit breaker box 118 connected to a supply line 119. Also connected to the breaker and element 116 is a thermocouple 120 located in the outlet piping 14. A transformer 122 is connected to the circuit breaker 118 and provides voltage to a room thermostat 124 which energizes, at a set temperature, a coil 126 to close contacts 128, 130 to energize motor 17 to drive pump 16. Energization of motor 17 is effected however only when contacts 132 in a second breaker 134 are closed. Contacts 132 are opened in the summer time or when space heating is not required. However, to prevent the thermocouple 120 to energize element 34 at such time, a switch S between the thermocouple and the power box 118 is also opened.

At the start, assuming only cold water is present in the tank, circuit breaker 118 is closed as well as switch S and element 32 is energized (element 30 does not operate due to the particular construction of standard water tanks where the two heating elements never operate simultaneously). Element 34 also is energized since the thermocouple 120 detects cold water in piping 14. If room temperature is below a set temperature, thermostat 124 will cause motor 17 (assuming contacts 132 are closed) to operate for circulation of hot water through radiators 18 and 18'. When the water going past the thermocouple 120 reaches a set temperature (about 155° F.), element 34 is de-energized. Thermostat 114, set at a given temperature (about 155° F.), de-energizes element 32. With element 32 de-energized, element 30 (set at about 145° F.) heats colder water in the lower part of the tank. Once the water inside the tank is sufficiently warm, elements 30, 32 and 34 are energized depending on the demand of hot water, either for space heating or domestic use, keeping in mind, however, that elements 30 and 32 never operate simultaneously.

Although the invention has been described above only in relation to specific forms, it will be evident to the man skilled in the art that it may refined and modified in various ways. For example, water conduits 12 and 14 may be short-circuited with valves to prevent hot water circulation to the radiators 18 during days where space heating is not required. Therefore, it is believed that this invention should not be limited in interpretation except by the terms of the following claims.

The embodiments of the invention in which an exclusive property or privilege is claimed are defined as follows:

1. A hot water heater for heating water for domestic use and water for space heating comprising:
   (a) a tank;
   (b) means for supplying water in said tank to be heated for domestic use;
   (c) a first electric heating element located in the lower part of said tank for heating said water for domestic use;
   (d) means for supplying water in said tank to be heated for space heating;
   (e) a heating unit mounted within said tank, said unit including:
      (i) first chamber means having openings for allowing said water for domestic use to circulate therethrough;
      (ii) a second electric element in said first chamber means;
      (iii) second closed chamber means for receiving the water supplied in said tank for space heating;
      (iv) heat exchange means in said second closed chamber means in heat collecting communication with said first chamber means;
      (v) third closed chamber means in fluid communication with said second closed chamber means;
      (vi) a third electric heating element in said third chamber means;
   (f) means for collecting heated space heating water from said third chamber means and for supplying that water for use; and
   (g) means for collecting from said tank and supplying heated water for domestic use.

2. A hot water heater as defined in claim 1 wherein said second chamber means consists of a plurality of serially connected compartments in fluid communication; each said compartment including one of said heat exchange means therein.

3. A hot water heater as defined in claim 2, wherein each of said heat exchange means consists of an inverted-U shaped hollow tubular member having portions extending into said first chamber means and contacting water passing through said first chamber means.

4. A hot water heater as defined in claim 1 wherein said heating unit is mounted at substantially mid-section of said tank.

5. A hot water heater as defined in claim 4 wherein said space heating water supply means and said space heating water collecting means include coil lines respectively disposed below and above said heating unit.

6. A hot water heater as defined in claim 5, comprising support means resting on said heating unit for supporting the coil line disposed above said heating unit.

7. A hot water heater as defined in claim 5, wherein said tank has a removable cover to facilitate removing said heating unit and said coil lines from said tank.

8. A hot water heater as defined in claim 4, comprising means on the inner wall of said tank for supporting said heating unit at substantially midsection of said tank.

9. A hot water system comprising a hot water heater as defined in claim 1, and means for circulating said water for space heating through said second and third chambers.

10. A hot water system as defined in claim 9, wherein said circulating means include a water pump and a motor.

11. A hot water system as defined in claim 10, comprising means for measuring the temperature of said hot water for space heating, said third electric heating element being operatively controlled by said temperature measuring means in response to the temperature of the space heating water.

12. A hot water system as defined in claim 11, comprising switch means preventing said motor to operate at predetermined time periods while allowing said first and second heating elements to operate for heating water for domestic use during said time periods.

* * * * *